US005987854A

United States Patent [19]

Killinger et al.

[11] Patent Number: 5,987,854

[45] **Date of Patent: *Nov. 23, 1999**

[54] METHOD AND APPARATUS FOR OPENING AND TRANSPORTING BAGS

[75] Inventors: Glenn W. Killinger; Gregory E. McDonald, both of Simpsonville; Charles C. Zende, Greer, all of S.C.

[73] Assignee: Cryovac, Inc., Duncan, S.C.

[ * ] Notice: This patent is subject to a terminal disclaimer.

[21] Appl. No.: 09/064,333

[22] Filed: Apr. 22, 1998

Related U.S. Application Data

[63] Continuation-in-part of application No. 08/857,277, May 16, 1997, Pat. No. 5,826,405.

[51] Int. Cl.[6] ..... B65B 43/30; B65B 43/36

[52] U.S. Cl. ..... 53/459; 53/570; 53/386.1

[58] Field of Search ..... 53/459, 468, 469, 53/570, 573, 385.1, 386.1, 381.6; 141/10, 114, 166, 313

[56] References Cited

U.S. PATENT DOCUMENTS

| | | | |
|---|---|---|---|
| 997,193 | 7/1911 | Hoyt . | |
| 2,601,480 | 6/1952 | Williams | 226/49 |
| 2,702,150 | 2/1955 | Vogt | 53/570 |
| 2,914,895 | 12/1959 | Martin | 53/59 |
| 3,059,550 | 10/1962 | Wellman | 93/29 |
| 3,161,347 | 12/1964 | Hannon | 229/69 |
| 3,501,888 | 3/1970 | Egli et al. | 53/86 |
| 3,552,090 | 1/1971 | Roberts et al. | 53/71 |
| 3,579,948 | 5/1971 | Lerner | 53/459 |
| 3,587,843 | 6/1971 | Wing | 206/57 |
| 3,740,922 | 6/1973 | Liou | 53/188 |
| 3,793,797 | 2/1974 | Roberts et al. | 53/459 |
| 3,804,322 | 4/1974 | Ericson | 229/53 |
| 3,908,343 | 9/1975 | Farrelly | 53/570 X |
| 4,137,958 | 2/1979 | Golby et al. | 150/1 |
| 4,159,611 | 7/1979 | Russell | 53/381.6 |
| 4,248,032 | 2/1981 | Woods et al. | 53/570 |
| 4,484,904 | 11/1984 | Fowler | 493/213 |
| 4,516,384 | 5/1985 | Imperiale | 53/459 |
| 4,674,268 | 6/1987 | Gavronsky et al. | 53/469 X |
| 4,795,413 | 1/1989 | Johnson et al. | 493/309 |
| 5,551,215 | 9/1996 | McDonald et al. | 53/459 |
| 5,826,405 | 10/1998 | Killinger et al. | 53/459 |

*Primary Examiner*—John Sipos
*Attorney, Agent, or Firm*—Mark B. Quatt

[57] ABSTRACT

A method of opening a bag mounted on a tape includes the steps of providing a bag including a first panel, a second panel, a first bag edge, a second bag edge, a bag bottom, and a bag mouth; gripping the bag between a first means for vacuumizing and a second means for vacuumizing; and moving the first and second means for vacuumizing such that the bag disengages from the tape, and the bag mouth opens. The first and second means for vacuumizing are activated before or during the gripping step, or after these means have been moved, but before the bag mouth opens. An apparatus for transporting a bag, and loading a bag, are also disclosed.

15 Claims, 15 Drawing Sheets

METHOD AND APPARATUS FOR OPENING AND TRANSPORTING BAGS

This application is a continuation-in-part of U.S. Ser. No. 08/857,277 filed May 16, 1997, now U.S. Pat. No. 5,826, 405.

FIELD OF THE INVENTION

The present invention relates to a method and apparatus for opening a bag mounted on a tape, and a method and apparatus for transporting the bag to a loading mechanism, where the product can be loaded into the bag.

BACKGROUND OF THE INVENTION

Many packaging applications, especially food packaging, require or benefit from the use of bags made from various thermoplastic materials and structures. Examples of commercial bags include heat shrinkable bags supplied by Cryovac, Inc., including the "L", B110, and B2550 bags.

These bags are commonly used in large scale meat processing and/or packaging systems where production speed and efficiency are important. Bags to be used in these systems are often themselves packed in boxes, the individual bags taped together so that they will feed in a predictable and efficient manner to an article loading station. Typical of such technology is U.S. Pat. No. 3,161,347 (Hannon), disclosing a tape to which bags are attached, and U.S. Pat. No. 3,587,843 (Wing), incorporated herein by reference in its entirety, disclosing two tapes to which are attached imbricated (i.e. shingled) bags.

At the loading station of a conventional system, each bag is opened and then loaded with an article such as a fresh red meat subprimal or smoked and processed meat, poultry, cheese, or other perishable food product, or other product.

In opening such bags, a problem sometimes encountered is that of bag lips ( the edges of the bag panels which form the bag mouth or opening) which can be undesirably stuck together, or stuck to the adhesive bag tapes. This occurs in conjunction with the use of adhesive tapes to hold a series of imbricated (shingled) bags. Lateral movement of the top ply of the lead bag relative to the bottom ply can cause the top ply of the bag to adhere to the adhesive tape, making it difficult to open the bag. This can create a significant slow-down in a packaging line, and down-time for the food processor or other user of bags. The bags can of course be opened manually, but this is very slow and labor intensive. It also risks unnecessary handling of the bag.

Some solutions have been offered to deal with the problem of opening a bag prior to the insertion of an article into the bag. The use of air pressure is common, but of course requires a source of air pressure. Sometimes the use of air pressure is unpredictable in providing consistent bag opening performance, and the operator sometimes still needs to manually start the opening process so that the air can be effective in further opening the bag sufficiently to allow an article to be loaded therein.

Another problem inherent in conventional bag loading systems is the requirement to match center to center tape spacing to the bag size and article cross section. "Tape spacing" here refers to the pair of adhesive carrier tapes, e.g. as described in the '843 Wing patent, which in many commercial bag loading systems hold bags together in an imbricated manner before loading with an article. Currently, the nature of the tape spacing will generally define the shape of the bag when it is opened. Since the bag dimensions are ideally matched to the dimensions of the article to be packaged, tape spacing is an important parameter in loading a bag with an article.

It is desirable to provide a method and apparatus which lessen or eliminate the requirement of opening the bag manually, or of using air pressure. It is also desirable to provide a method of opening the bag in a reliable and consistent manner, which allows for increased automation, and potentially reduces operating costs.

Likewise, it is desirable to provide a method and apparatus which lessen or eliminate the requirement of matching tape spacing to article size, i.e. the requirement of optimizing tape spacing for feeding or indexing the bags.

Another problem often encountered in the packaging of food products is that the corners of each bag tend to curl over during bag advance and loading. This can sometimes complicate or slow the bag loading process. By finding a way to widen the tape spacing, that is, by placing the tapes closer to the bag's respective lateral edges, without being unduly limited in the need to match tape spacing to bag and article size, this problem is lessened or eliminated.

In transporting bags mounted on a tape, in conventional systems, a discharged package (i.e. a product such as a fresh red meat packaged in a bag) is required to travel over the bag train, i.e. a plurality of imbricated bags mounted on tapes. A disadvantage of such a system is that bags can be knocked off the bag train by the packaged product as it is transported. Another problem common in conventional systems is that the packaging machine takes up a significant amount of floor space. In processing plants, where floor space is at a premium, this can be an important factor. It is desirable to provide a method and apparatus which reduces or eliminates the problem of bags being knocked off the bag train by packaged products, and which reduces the overall floor length of the machine, preferably without sacrificing the ability to horizontally load.

SUMMARY OF THE INVENTION

In a first aspect, a method of opening a bag mounted on a tape comprises providing a bag comprising a first panel, a second panel, a first bag edge, a second bag edge, a bag bottom, and a bag mouth; providing a first means for vacuumizing and a second means for vacuumizing; drawing a vacuum through said first means for vacuumizing and second means for vacuumizing; gripping the bag between the first means for vacuumizing and the second means for vacuumizing; and moving the first and second means for vacuumizing such that the bag disengages from the tape, and the bag mouth opens.

In a second aspect, a method of opening a bag mounted on a tape comprises providing a bag comprising a first panel, a second panel, a first bag edge, a second bag edge, a bag bottom, and a bag mouth; gripping the bag between a first means for vacuumizing and a second means for vacuumizing; drawing a vacuum through the first means for vacuumizing and the second means for vacuumizing; and moving the first and second means for vacuumizing such that the bag disengages from the tape, and the bag mouth opens.

In a third aspect, a method of opening a bag mounted on a tape comprises providing a bag comprising a first panel, a second panel, a first bag edge, a second bag edge, a bag bottom, and a bag mouth; gripping the bag between a first means for vacuumizing and a second means for vacuumizing; and moving the first and second means for vacuumizing, and, while moving the first and second means for vacuumizing, drawing a vacuum through the first and second means for vacuumizing such that the bag disengages from the tape, and the bag mouth opens.

In a fourth aspect, a method of transporting a bag, the bag comprising a first panel, a second panel, a first bag edge, a second bag edge, a bag bottom, and a bag mouth, comprises advancing a pair of pressers to the interior of the bag mouth, the bag mouth being in an open position and defining a first plane; moving the pressers transversely away from each other to press against the interior of the bag mouth; and activating a means for actuating to advance the bag, held by the pair of pressers, such that the bag mouth advances from the first plane to a second plane different from the first plane.

In a fifth aspect, an apparatus for transporting a bag, the bag having a first panel, a second panel, a first bag edge, a second bag edge, a bag bottom, and a bag mouth, comprises a presser assembly comprising a first shaft and a second shaft, the first and second shafts spaced apart from each other; a first cam and a second cam, the first and second cams spaced apart from each other and traversably mounted on first and second shafts respectively; a first presser and second presser, the first and second pressers mounted on first and second cams respectively; a plate cam disposed intermediate the first shaft and a second shaft, the plate cam capable of causing rotation of the first and second presser through a 90° arc; and a means for actuating the presser assembly.

In a sixth aspect, an apparatus for loading a bag with a product, the bag having a first panel, a second panel, a first bag edge, a second bag edge, a bag bottom, and a bag mouth, comprises a means for pushing the product; a means for actuating the means for pushing the product; and a loading horn comprising a lower horn section, an upper horn section extending from the lower horn section at a pivoting joint, and an upper horn section having a transverse slot wherein the upper horn is capable of lateral expansion to accommodate the product.

BRIEF DESCRIPTION OF THE DRAWINGS

In the drawings presented by way of illustration of the invention.

DESCRIPTION OF THE PREFERRED EMBODIMENTS

The invention involves in three aspects three functions; namely, bag opening, bag transporting, and bag loading.

Figure 1:
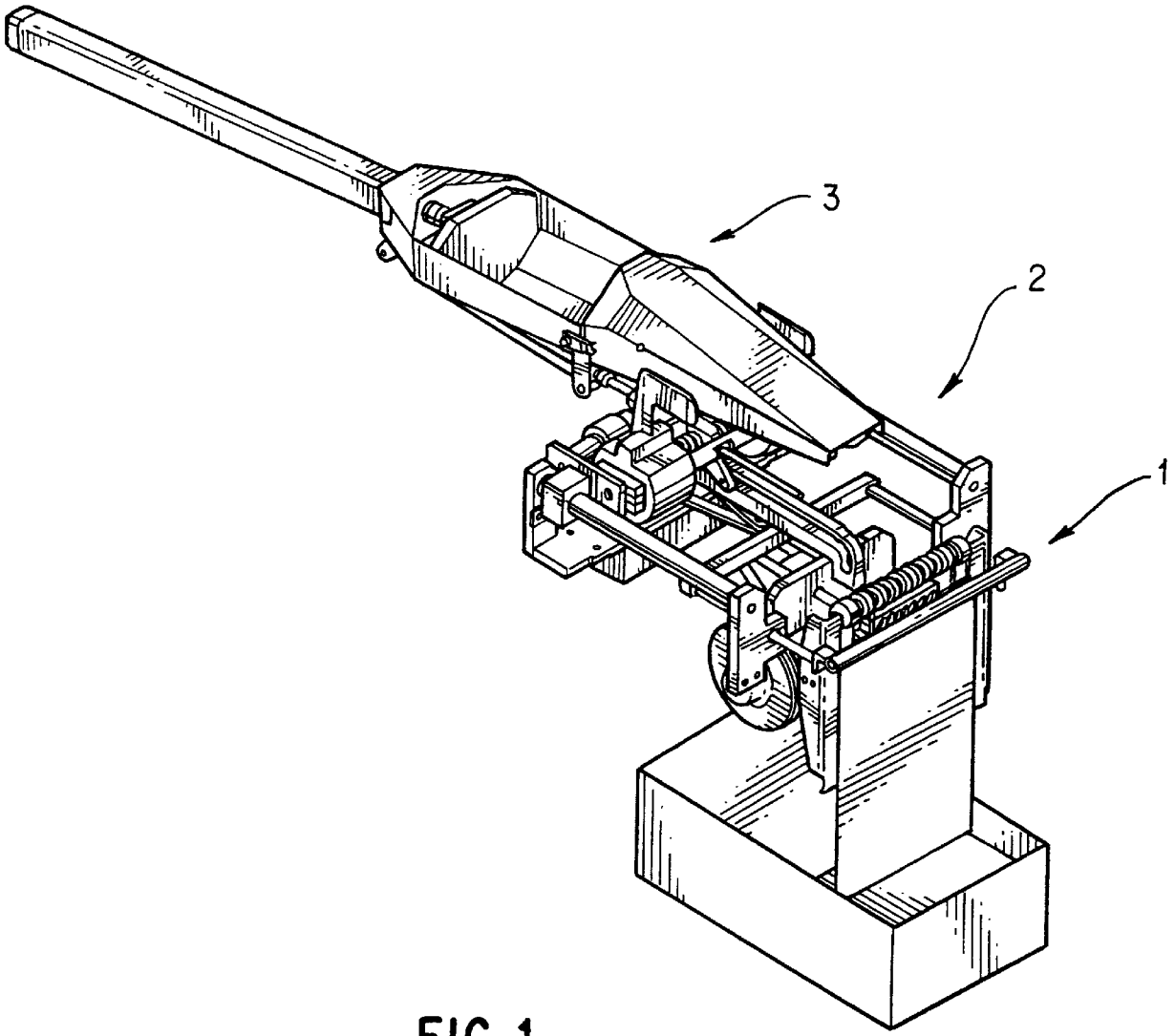
FIG. 1 is a perspective view of an apparatus for opening, transporting, and loading a bag.

With reference to FIG. 1, these functions are implemented with a bag opening apparatus [1], a bag transporting apparatus [2], and a bag loading apparatus [3]; each are described in detail below.

Bag Opening Apparatus [1]

Figure 2B:
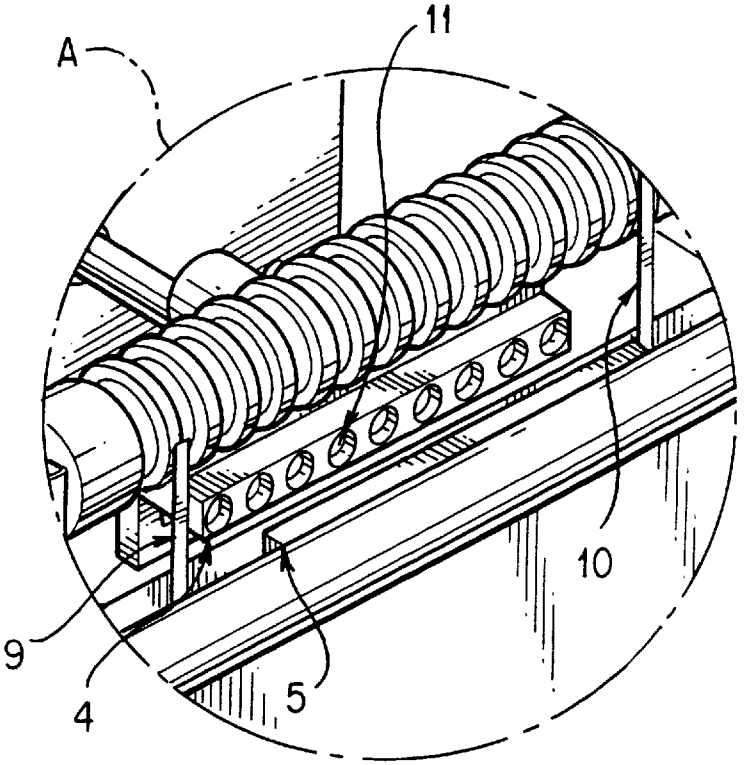
FIG. 2*b* is an enlarged perspective view of a portion of FIG. 2*a*.
Figure 2A:
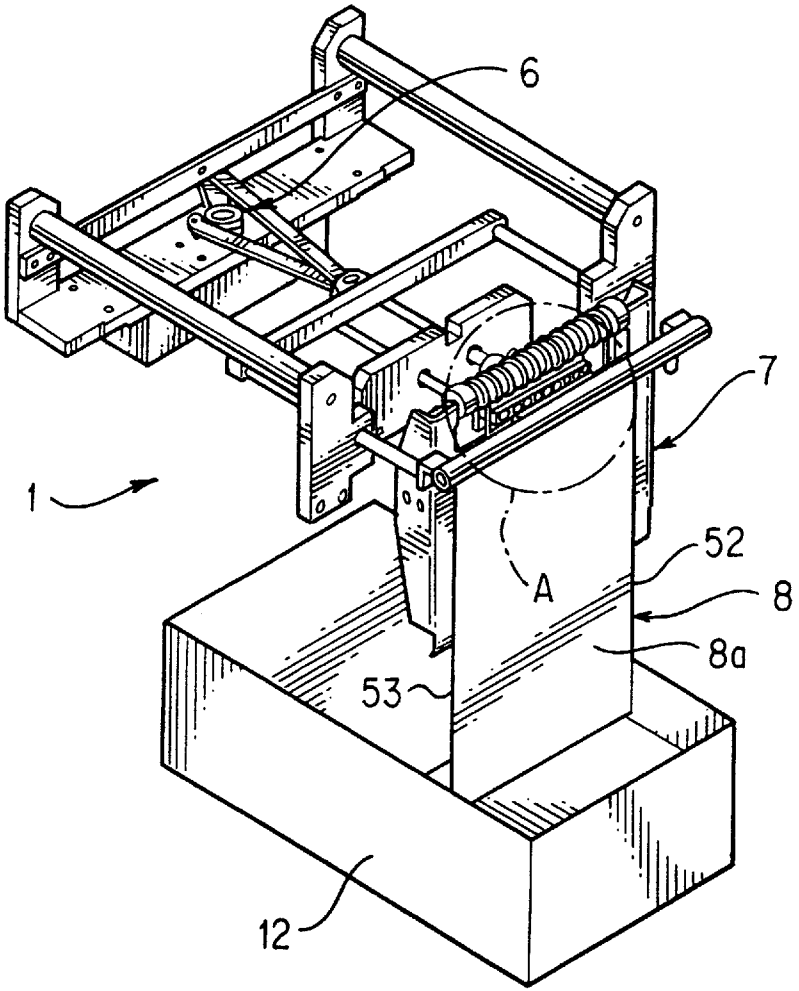
FIG. 2*a* is a perspective view of the apparatus for opening a bag.

With reference to FIGS. 2*a* and 2*b*, the bag opening apparatus [1] comprises a first means for vacuumizing [4], a second means for vacuumizing [5], an actuator [6], and a bag platform [7] which accommodates an imbricated bag [8] mounted on tapes [9 and 10]. The actuator can be any suitable conventional device, mechanical, pneumatic, hydraulic, electromechanical, etc. which serves to selectively advance or retract other components of the bag opening apparatus.

Bag [8] is preferably imbricated or shingled with like bags from a bag supply box [12]. A bag [8] typically includes a first panel [8*a*], and a second panel [8*b*] (see FIG. 6) on the opposite side of the bag from first panel [8*a*]. Each panel can be regarded as having a first and second end, and a first and second lateral edge. As viewed in a substantially lay-flat condition, the two panels each preferably have substantially the same length and width. Respective communicating first edges of the first and second panels form a first bag edge [52]. A second bag edge [53] is formed by respective communicating second edges of the first and second panels. A bag bottom [55] is formed by respective communicating first ends of the first and second panels. A bag mouth [56] is formed by respective communicating second ends of the first and second panels.

Bags are typically made as side seal bags or end seal bags.

The side seal bag will have a factory-made heat seal at opposite bag edges. The bag bottom will be formed by the fold of film created during the extrusion of bag tubing during manufacture. The opposite fold of film is slit to form a bag mouth.

An end seal bag will have opposite bag edges formed by the fold of film created during the extrusion of bag tubing during manufacture. The bag bottom will be a heat seal. The bag mouth is formed by a transverse cut in the extruded tubing.

In both of these cases, the bag is typically made from a long length of bag tubing.

It is of course possible to use this invention with other embodiments, such as two discrete film panels which are preferably of substantially the same size, and brought together and sealed along two edges and the bottom to form a bag. Thus, although each panel (i.e. major wall) of the bag can be regarded as having a first end, first and second edges, and a second end, and although the bag edges are described as being joined portions of respective edges of the first and second panels of the bag, it will be understood that in fact a particular bag edge, bag bottom, or bag mouth can be formed or derived either from a true seal between two webs or panels of film, or from a fold of an originally single web of film, such as the tubular extruded "tape" typical of many film making operations.

Bags made from tubing at a processor's facility, such as those made in accordance with U.S. Pat. No. 5,618,252 (Melville), incorporated by reference herein in its entirety, can also benefit from the opening, transporting and loading aspects of the present invention.

Also, pouches having seals on three sides thereof (other than the bag mouth side) can also benefit from the opening, transporting and loading aspects of the present invention.

Figure 3B:
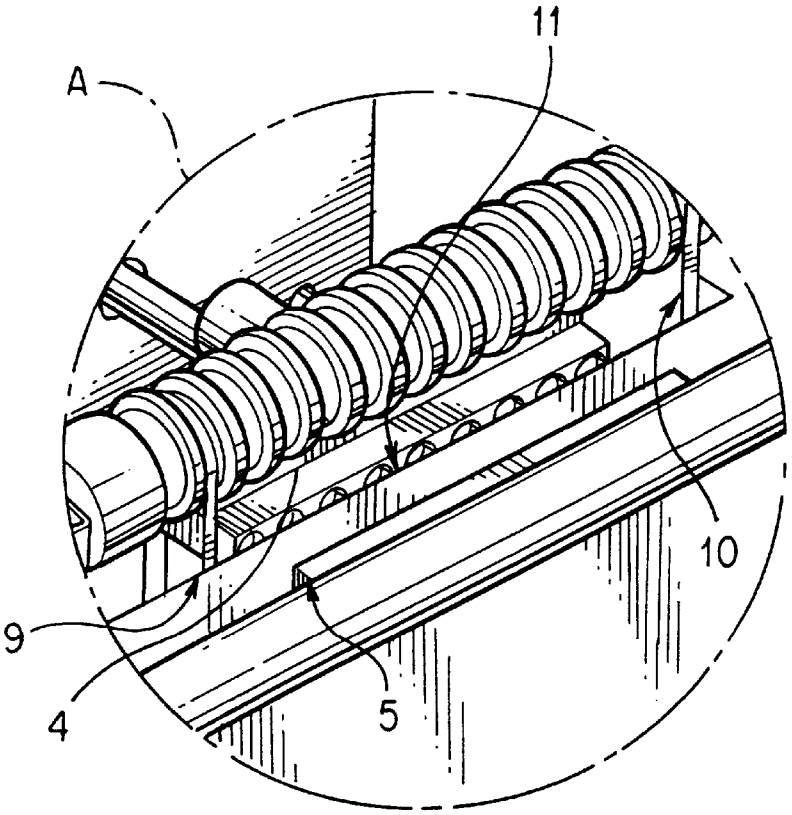
FIG. 3*b* is an enlarged perspective view of a portion of FIG. 2*a*.
Figure 3A:
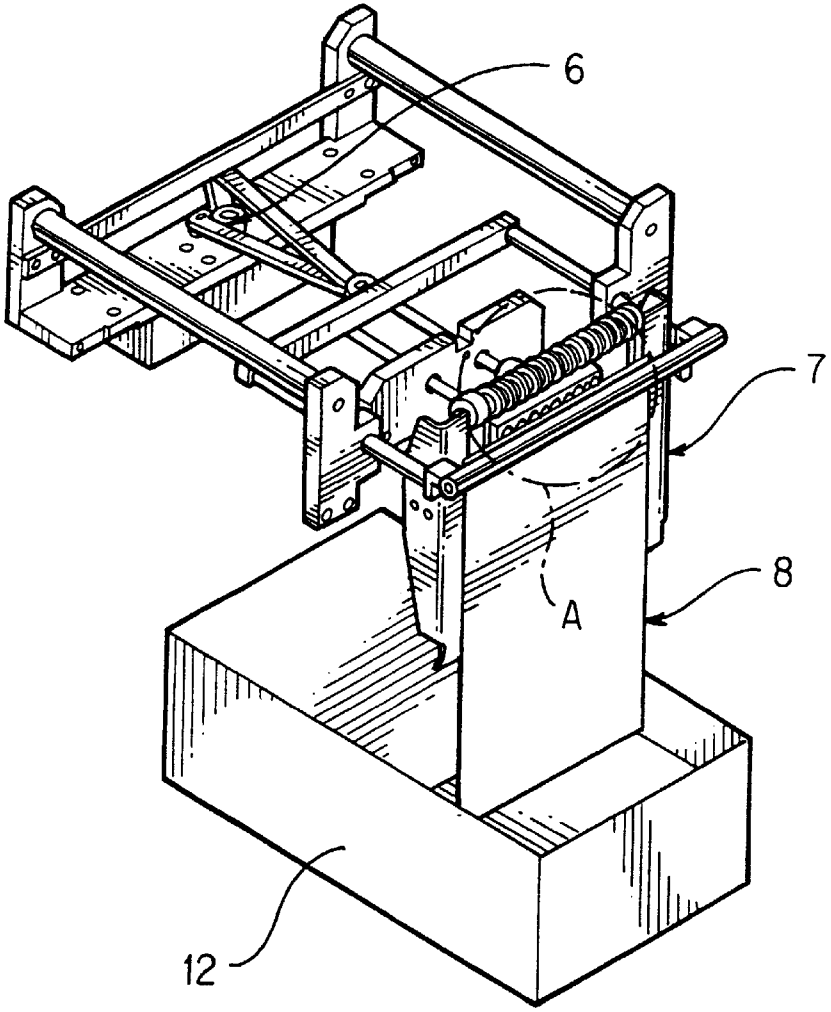
FIG. 3*a* is a perspective view of a leading edge of a bag positioned between first and second vacuumizing means.
Figure 4:
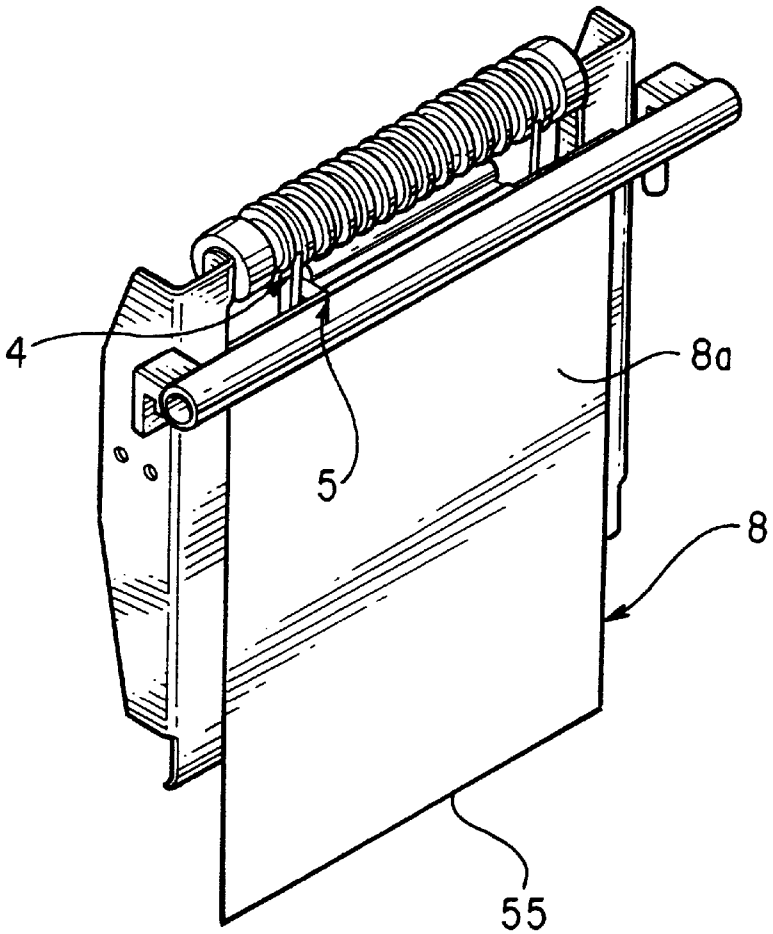
FIG. 4 is a perspective view of a bag gripped between vacuumizing means.
Figure 5:
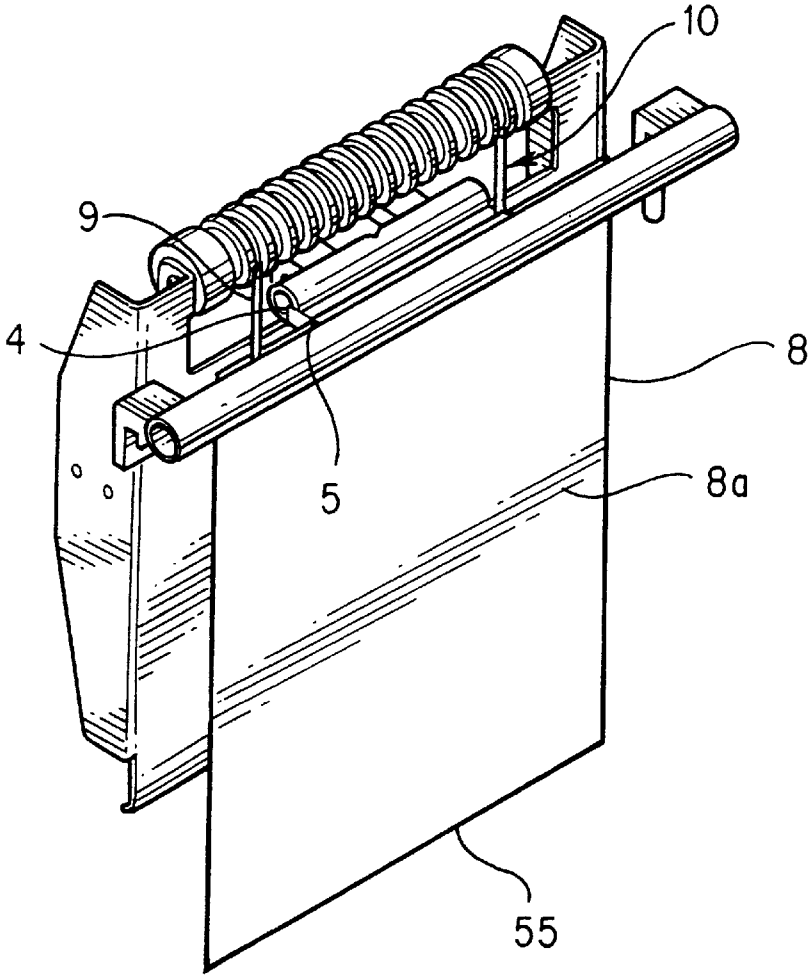
FIG. 5 is a perspective view of a bag, wherein the bag has been detached from the tapes by moving the bag away from the tapes.
Figure 6:
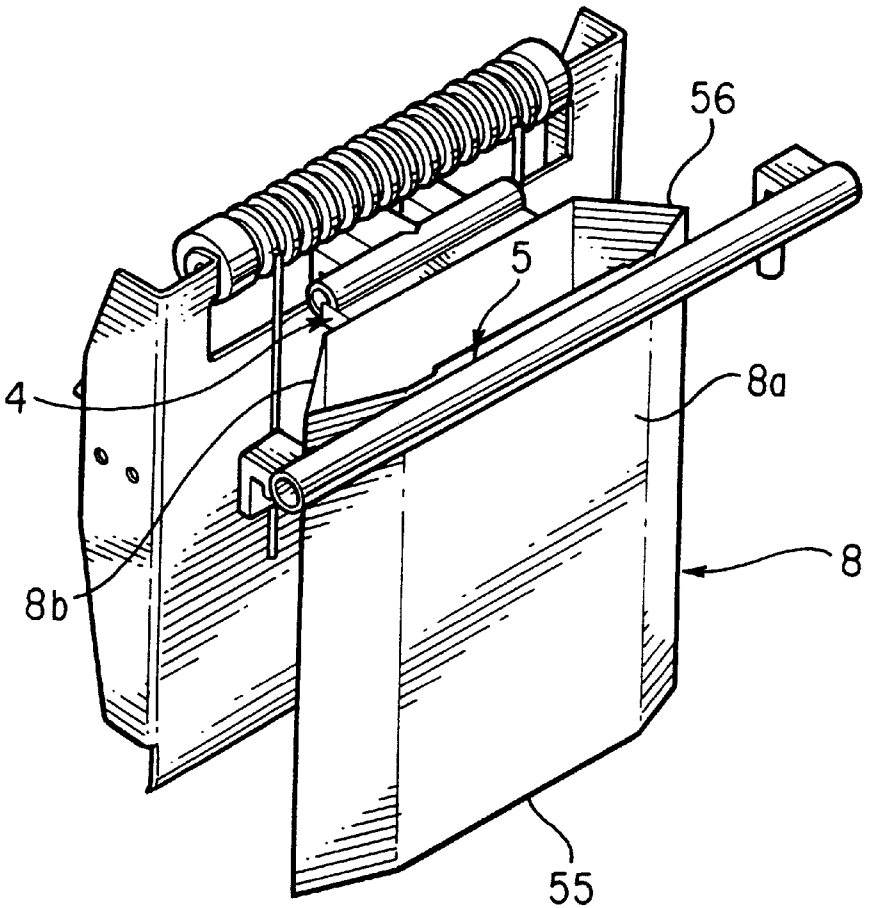
FIG. 6 is a perspective view of an apparatus and method of opening a bag, wherein the bag mouth has been opened.

The first and second means for vacuumizing have multiple vacuum ports [11] to secure a bag panel to the means for vacuumizing. In operation, a bag is opened by indexing a bag [8] so that the bag mouth [56] (best seen in FIGS. 6 and 7 in an open position) is preferably at or slightly above the top surface of the means for vacuumizing [4 and 5] as shown in FIGS. 3*a* and 3*b*. From this position, bag opening is accomplished by advancing the first and second means for vacuumizing toward each other, and gripping the bag [8] as shown in FIG. 4. While maintaining contact with the bag [8], the first and second means for vacuumizing [4 and 5] are moved away from tapes [9 and 10], thus stripping the bag from the tapes as shown in FIG. 5. With vacuum activated, i.e. drawing the vacuum through means [4 and 5], the motion of first means for vacuumizing [4] is stopped, but the second means for vacuumizing [5] continues its motion away from the tape to open the bag [8] as shown in FIG. 6. It is necessary that vacuum on the first and second means for vacuumizing [4 and 5] be drawn prior to their separation, i.e. prior to the point in time that the motion of first means for vacuumizing [4] stops, but the second means for vacuumizing [5] continues its motion away from the tape to open the bag. However, vacuum on the first and second means for vacuumizing [4 and 5] can be drawn at any time in the opening sequence after the bag has been initially indexed into position. Thus, depending on the embodiment, vacuum can be drawn through means [4 and 5] prior to when means [4 and 5] are brought together to grip the bag; or after means [4 and 5] are brought together to grip the bag; or in one embodiment even after means 4 and 5 are initially moved together to detach the bag [8] from the tapes [9 and 10]. In fact, vacuum can be drawn almost continuously through means [4 and 5], although vacuum should be discontinued during the time that the opened bag is to be advanced by the bag transporting means as described herein, and during the time that the next bag is to be advanced into position for opening, since continued vacuumization at either of these stages (which can be simultaneous) would interfere with the freedom of movement of the bag.

Bag Transporting Apparatus [2]

Figure 7:
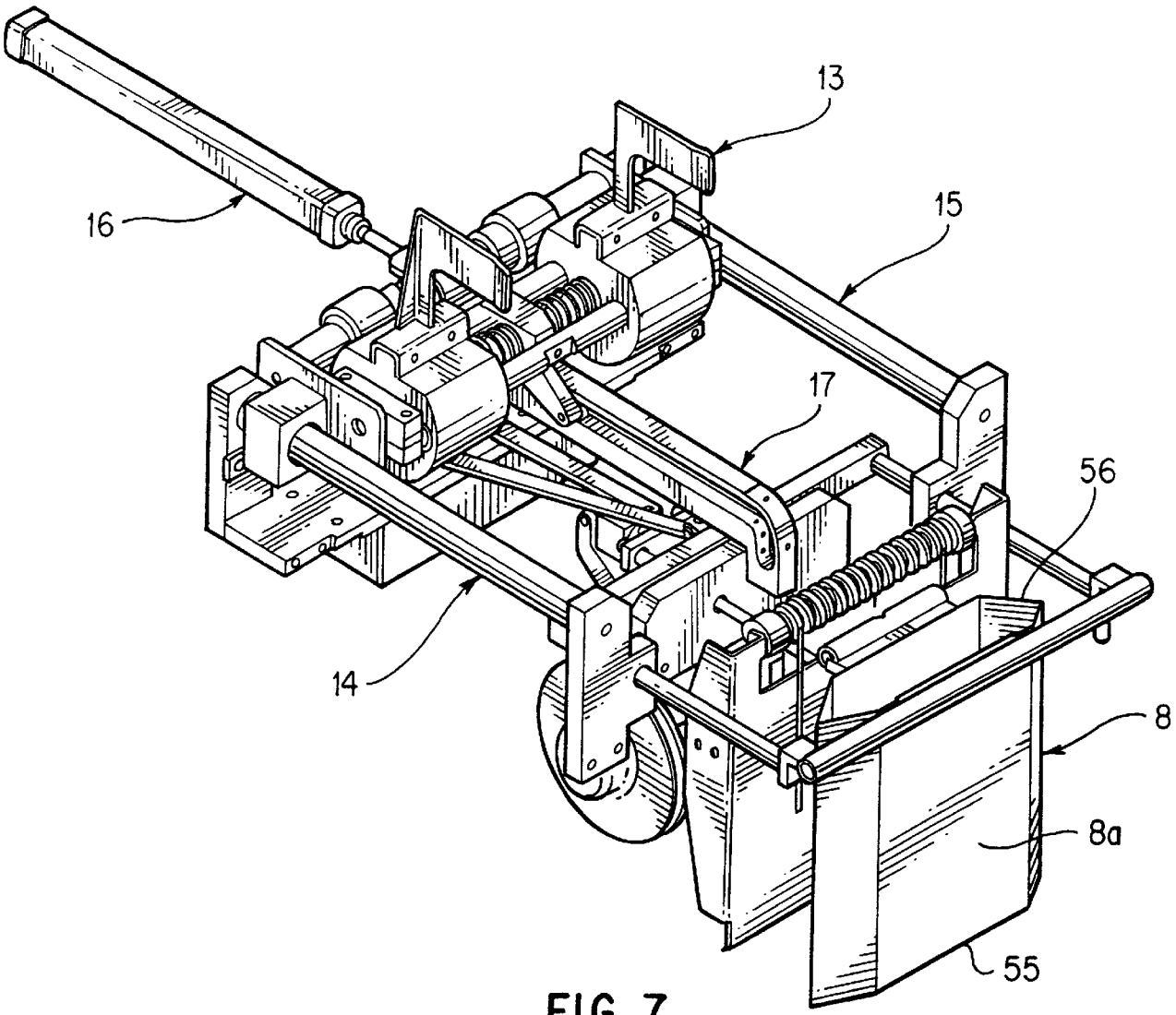
FIG. 7 is a perspective view of an apparatus for transporting a bag, with the bag mouth opened and detached from the tapes.
Figure 8A:
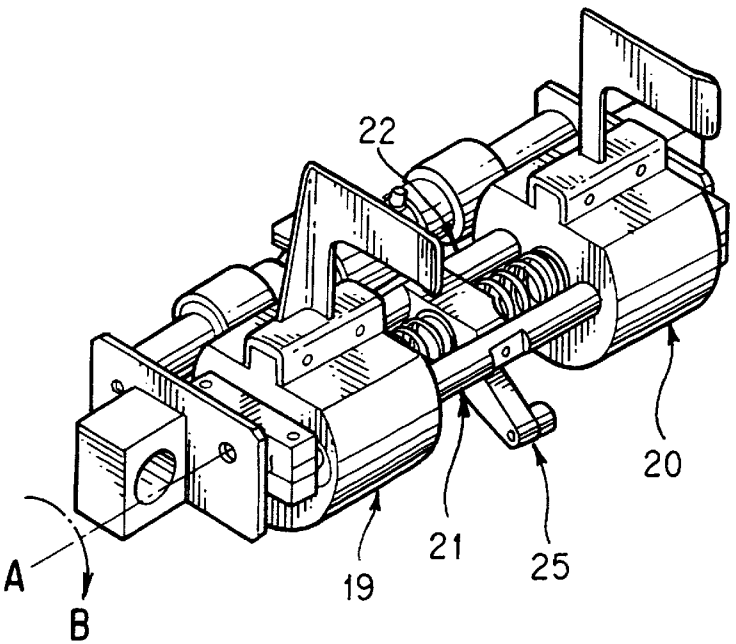
FIG. 8*a* is a perspective view of the presser assembly of the apparatus of FIG. 7.
Figure 8B:
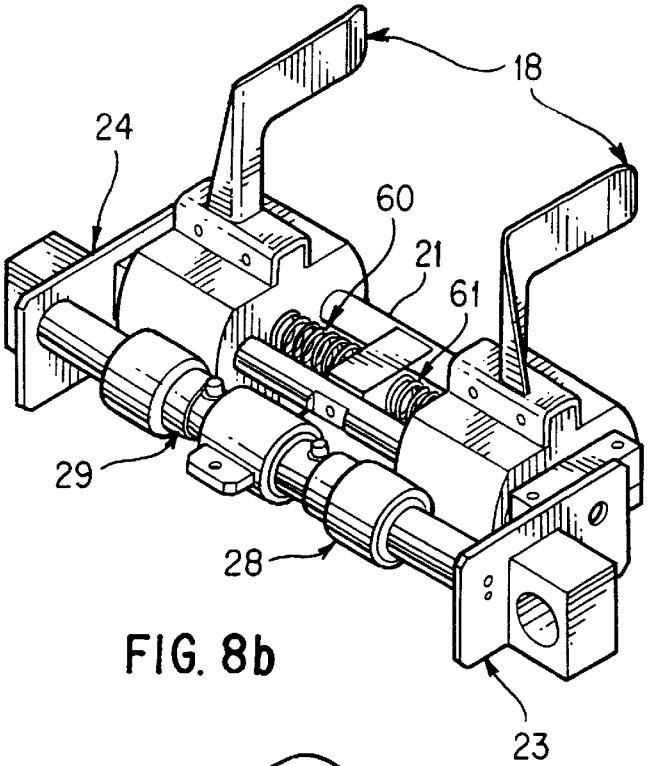
FIG. 8*b* is a rear perspective view of the presser assembly.
Figure 8C:
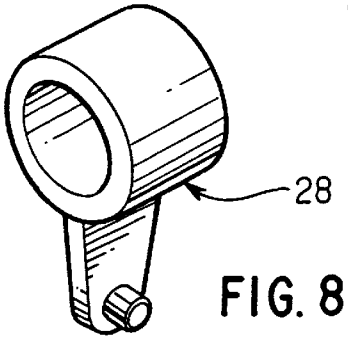
FIG. 8*c* is a perspective view of a follower forming part of the presser assembly.
Figure 9B:
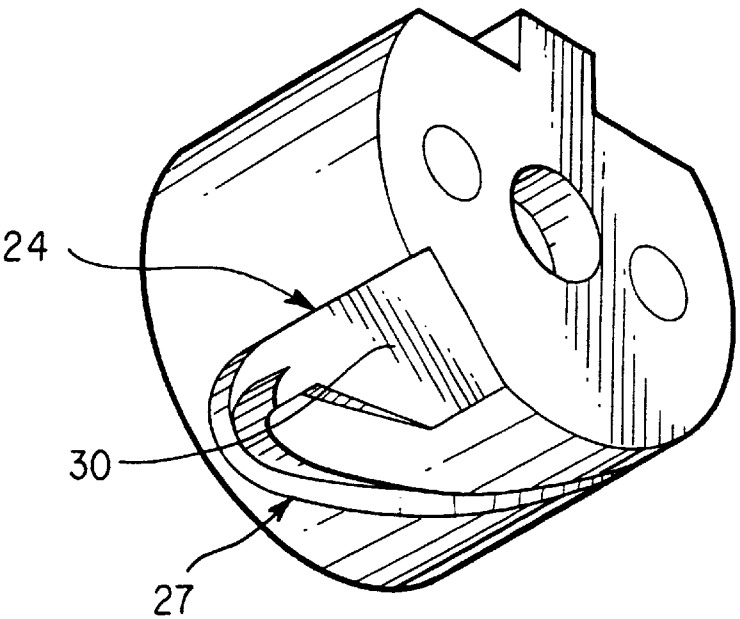
FIGS. 9*a* and 9*b* are different perspective view of barrel cams.
Figure 9A:
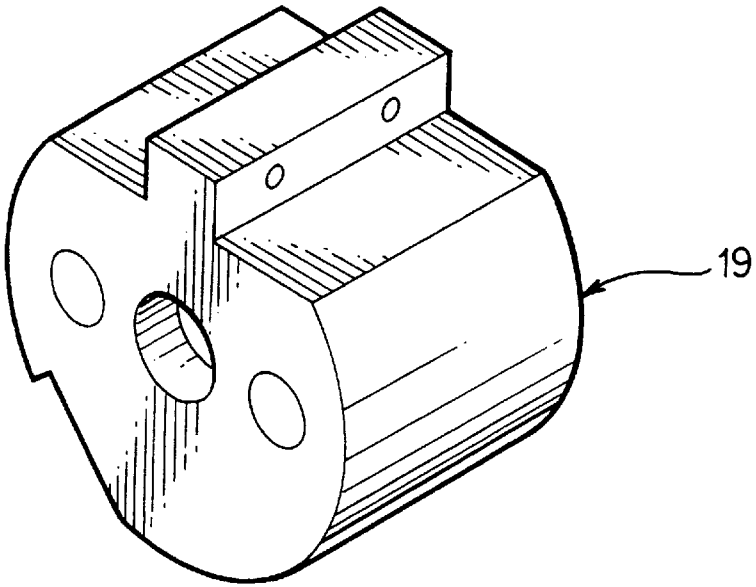

With reference to FIG. 7, the bag transporting apparatus comprises a presser assembly [13] traversable on shafts [14 and 15] when actuator [16] is activated. The actuator can be any suitable conventional device, mechanical, pneumatic, hydraulic, electromechanical, etc. which serves to selectively advance or retract other components of the transporting apparatus. Interactive with the presser assembly [13] is plate cam [17]. In operation, as actuator [16] extends (FIGS. 8 and 10), the presser assembly is caused to rotate about axis 'A' in direction 'B'. The presser assembly is further illustrated in FIGS. 8*a* and 8*b*, showing pressers [18] mounted on barrel cams [19 and 20] which are traversable on shafts [21 and 22] against spring pressure supplied by springs [23 and 24]. The pressers are depicted as paddles, but any suitable arms, blades, fingers, rods, or other projections of any suitable geometry can be beneficially used provided they function in cooperation with the other components of the bag transporting apparatus as described herein. Shafts [21 and 22] are mounted in housings [60 and 61] which rotate about axis 'A' when driven by cam follower [25]. Traversing motion of cam [19] on shafts [21 and 22] is controlled by cam groove [27] (see FIG. 9*b*) interacting with follower [28] (see FIG. 8*c*) which ban rotate around shaft [29]. Contact of follower [28] with cam [19] is maintained by a torsional spring [not shown]. As the cams [19 and 20] rotate in direction 'B,' the cams move symmetrically towards each other for approximately 90 degrees of rotation at which point cam follower [28] reaches a portion of cam groove [27] parallel with shafts [21 and 22], allowing the springs [23 and 24 ] to force the cams away from each other. As the bag transport sequence is described herein, it will be seen that the extent of the motion is constrained by the bag being transported. As the rotary motion is reversed, the cam follower [28] rotates about shaft [29], climbs the inclined portion of the cam groove [30], and reseats in the groove after approximately 90 degrees of rotation in the direction opposite to 'B.'

Figure 10:
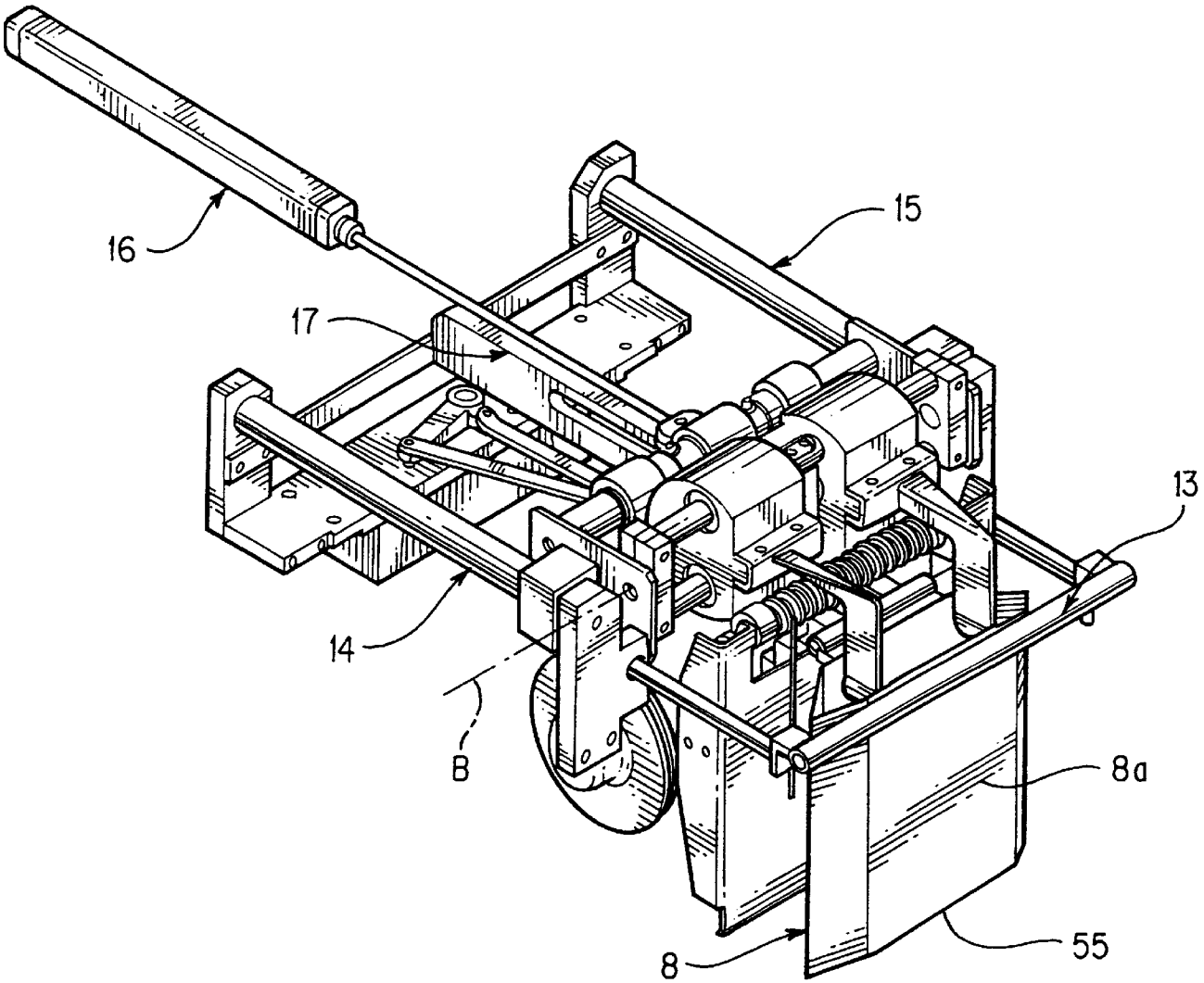
FIG. 10 is a perspective view of the presser assembly advanced to a position where the pressers have entered the bag mouth.

In operation, to transport a bag [8] opened by the bag opening means [1], the actuator [16] is activated by suitable controls, causing the bag transporting apparatus to traverse shafts [14 and 15] with cam [17] effecting a rotation around axis 'B,' and cams [19 and 20 ] narrowing the distance between pressers [18] to a width sufficient for the pressers 18 to partially enter the bag [8] as shown in FIG. 10.

Figure 11:
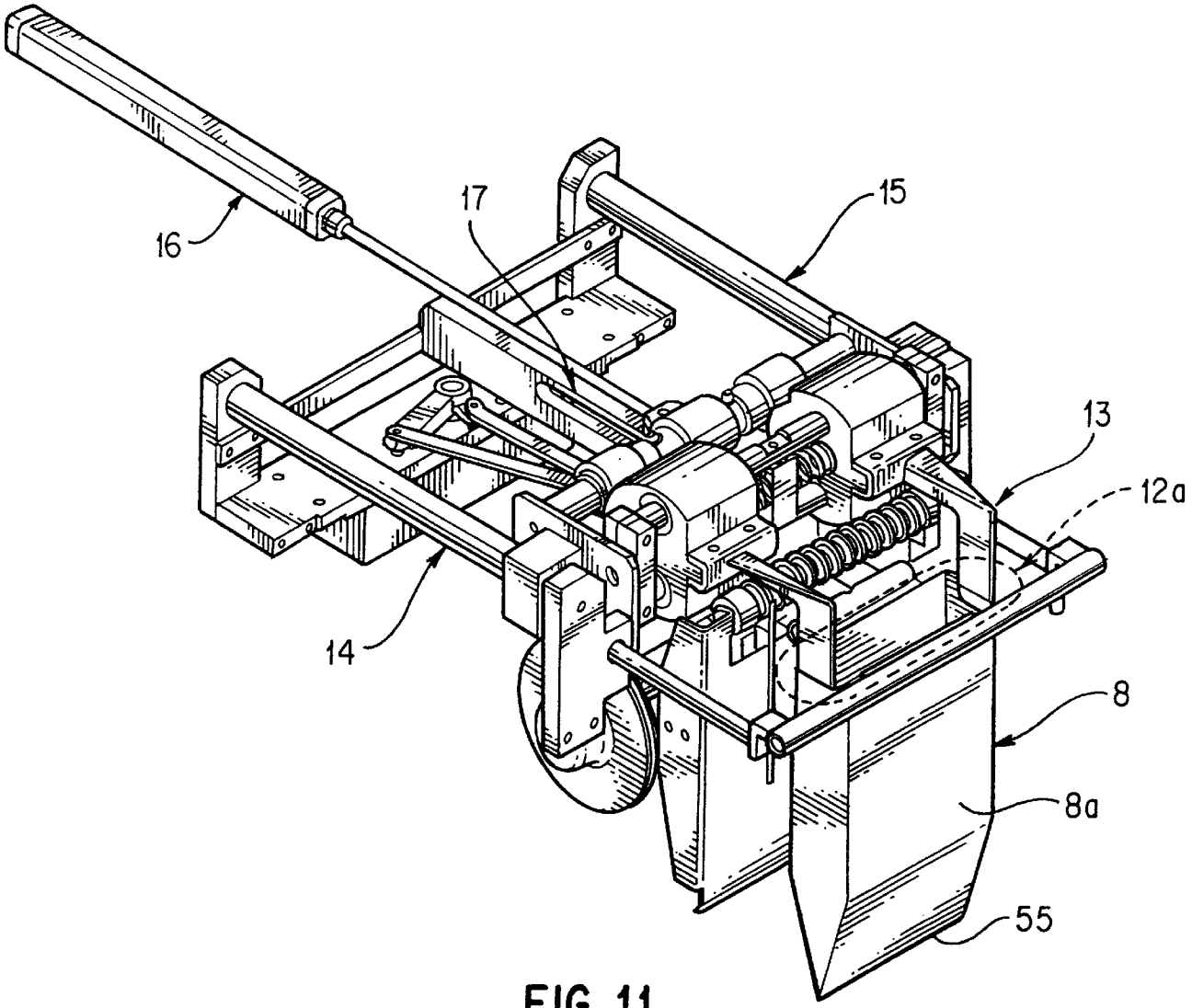
FIG. 11 is a perspective view of the presser assembly advanced to a position where the pressers are pressing against the interior of the bag mouth.

Just prior to completing the rotation into the bag [12], springs [23 and 24] spread the pressers [13] transversely away from each other, thus gripping the interior of the bag mouth 56 as shown in FIG. 11. By retracting actuator [16], the pressers [18] reverse their rotation, bringing the bag opening with its cross section initially in a substantially horizontal position [See FIG. 11, showing a dotted oval pattern 12*a* indicating the horizontal plane of the bag mouth] to a substantially vertical position as shown in FIG. 12.

The bag transporting apparatus thus allows the bag to be transported such that the plane defined by the bag mouth changes from a horizontal to a vertical position.

Figure 12:
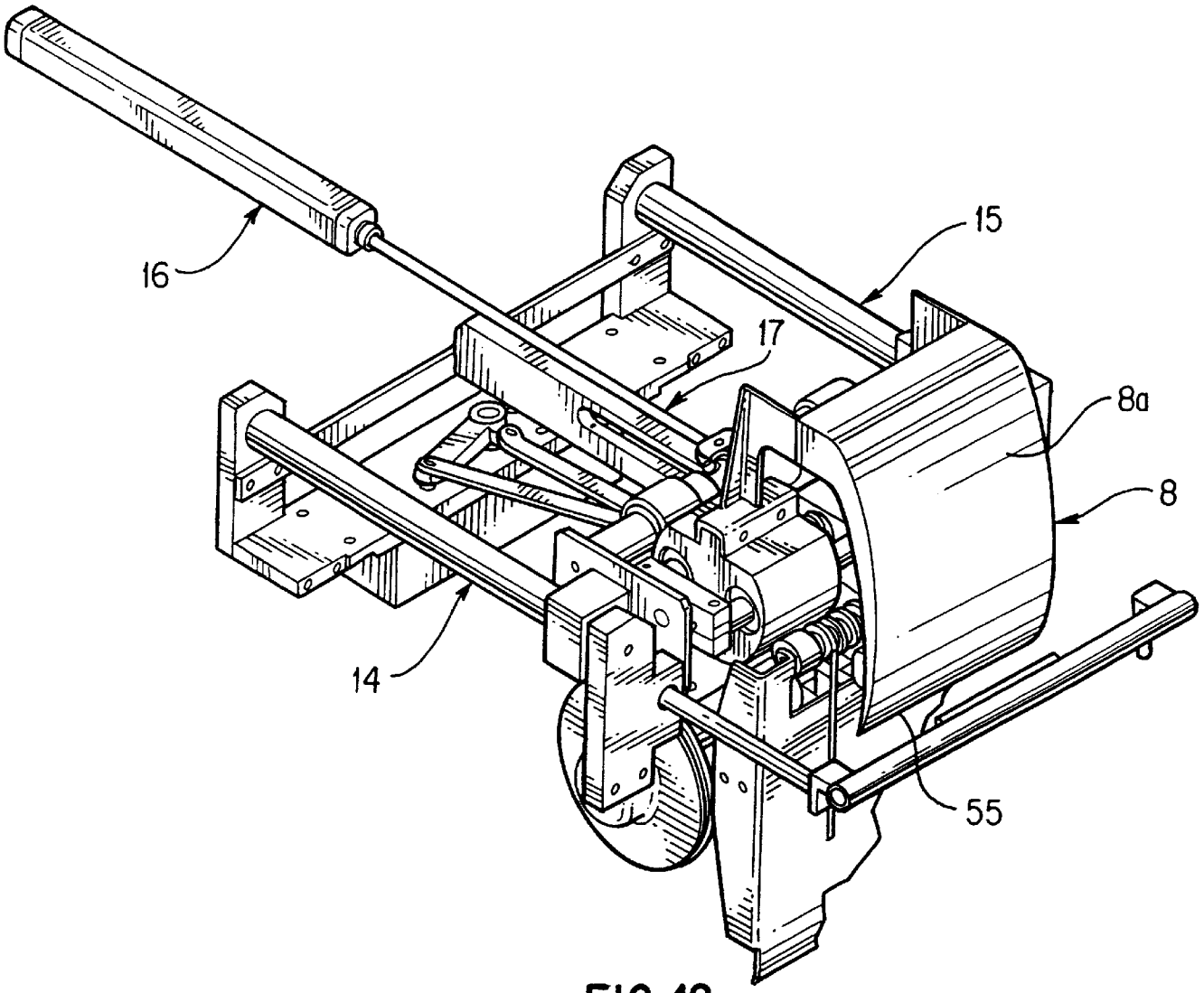
FIG. 12 is a perspective view of the presser assembly at a partially returned position, where the pressers continue to press against the interior of the bag mouth, and the bag mouth is disposed in a substantially vertical plane.
Figure 13:
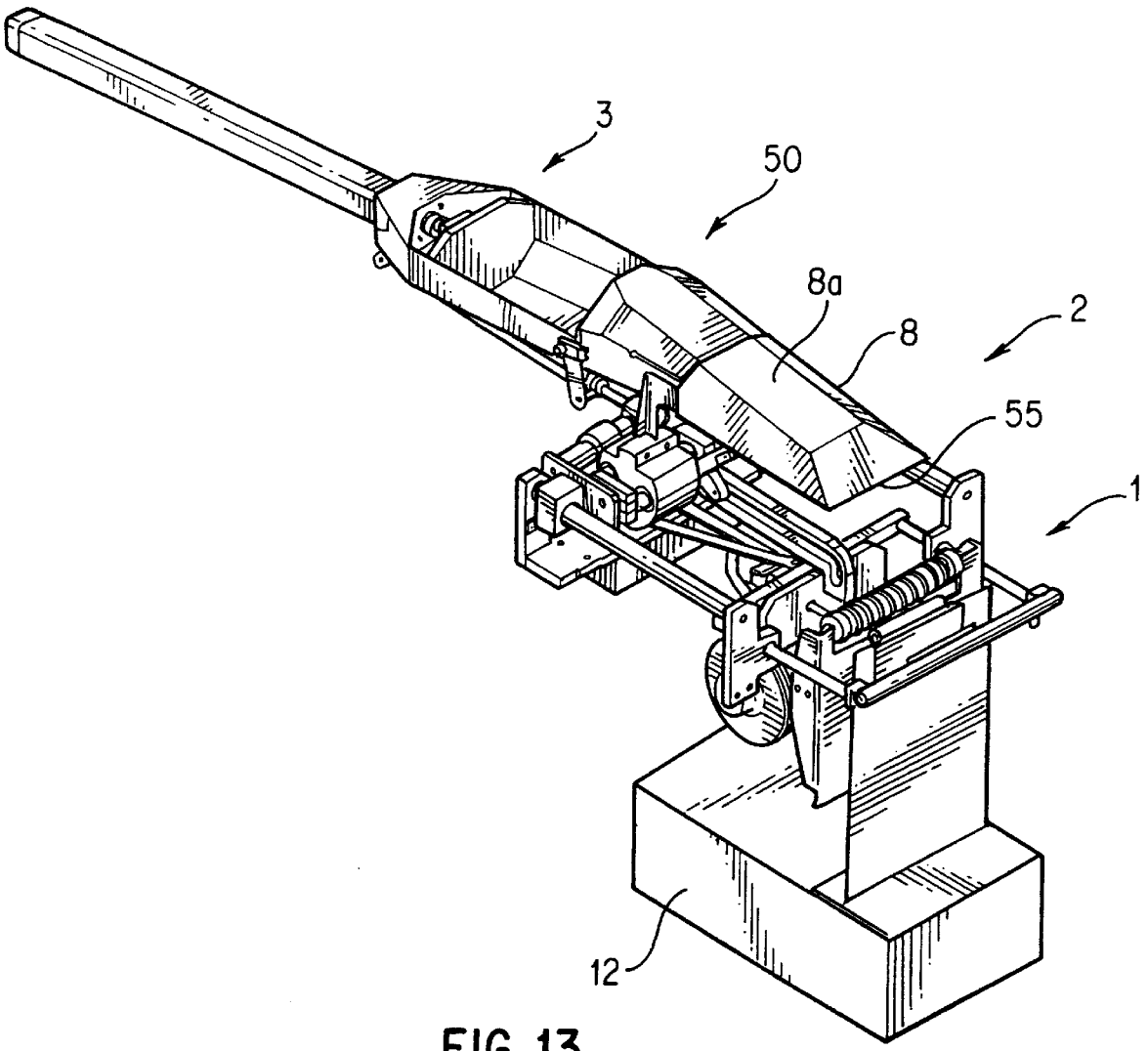
FIG. 13 is a perspective view of a loading apparatus in cooperation with apparatus for opening and for transporting a bag.

From the position shown in FIG. 12, continued retraction of the actuator [16] pulls the bag onto the horn 50 as shown in FIG. 13, completing the transporting of the bag.

It should be noted that the plate cam 17 controls the rate of rotary motion of the paddles 18 around 'axis B'. This motion could alternatively be controlled with a rotary pneumatic cylinder, a servo motor or mechanical linkage. The plate cam 17 is preferable because of the flexibility it allows in designing the path of the paddles. The same function can be achieved using a servo motor, although this would incur a greater expense. The path of the paddles could be reproduced by the use of a rotary actuator or mechanical linkage, but only with difficulty.

Bag Loading Apparatus [3]

Figure 14:
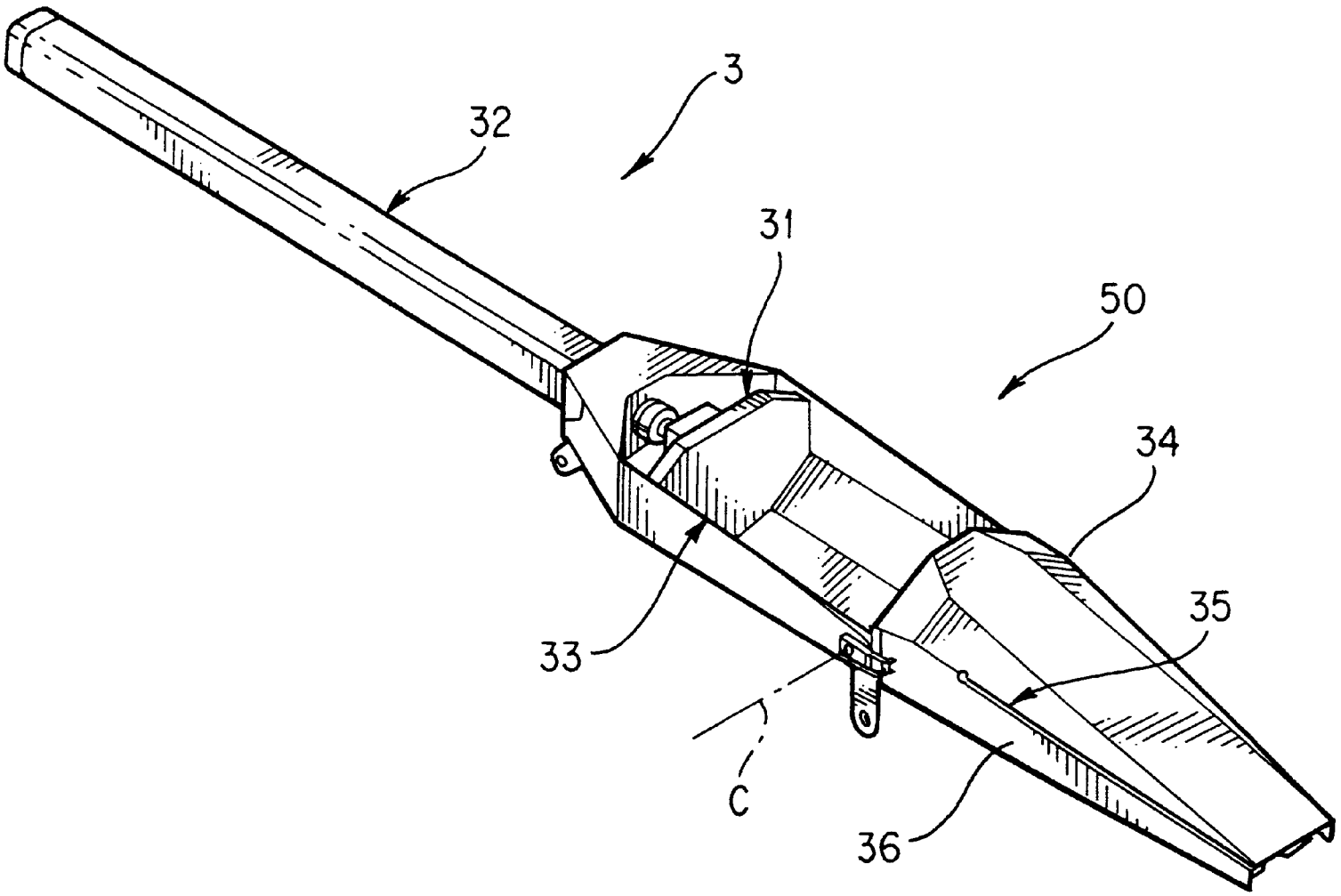
FIG. 14 is a perspective view of a loading apparatus.
Figure 15:
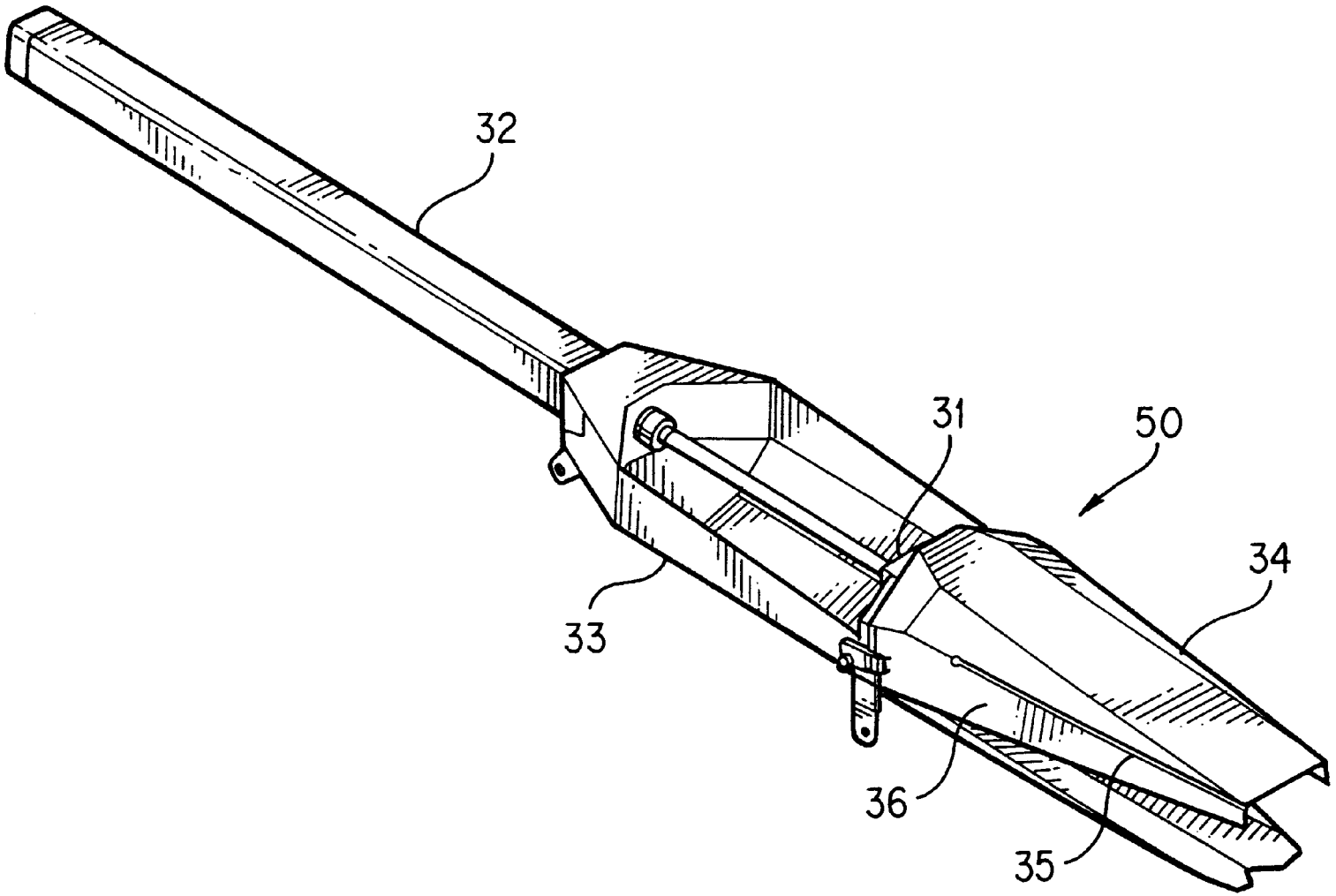
FIG. 15 a perspective view of a loading apparatus with a loading horn in an open position.

With reference to FIG. 14, the bag loading means consists of a product pusher [31] with its actuator [32], a lower horn section [33], and an upper horn section [34]. The actuator can be any suitable conventional device, mechanical, pneumatic, hydraulic, electromechanical, etc. which serves to selectively advance or retract other components of the loading apparatus. The upper horn section [34] can pivot around axis 'C,' and with slot [35], section [36] is expandable laterally. These pivoting and lateral expanding features allow the horn [50] to accommodate a wide variation in product shapes. These products are preferably various subprimals of fresh red meat, smoked and process meat, poultry, cheese, and the like.

To load a bag, a product is positioned in the hopper section or cavity formed in the lower horn section [33], and actuator [32] extends the product pusher [31] forward, forcing the product into the bag. The smooth tapered form of the upper and lower horn sections [34 and 33 respectively], and the pivot and lateral expansion features described above, allow the product to be pushed into the bag with little resistance. In addition, the tapered shape of the horn provides for a relatively small cross-section at the end of the horn to facilitate bag loading.

Several advantages are obtained by the present invention. The invention addresses the problem of stuck bag lips, especially when using end seal bags, by removing the bag from the tape prior to opening. Also, air inflation of the bag, although useable in connection with the invention, is no longer required.

In addition, the final dimensions of the bag opening are controlled by the disposition of the first and second means for vacuumizing, and not by the tape spacing, eliminating the need to have multiple tape spacings for different product profiles, as is the case when inflating a bag on conventional opening systems.

The invention places the unopened bag in a vertical position, eliminating "bag knock off", in which discharged packages traveling over the bag train can dislodge yet unopened bags further down the bag train. Also, the overall length ("footprint") of the equipment is reduced without sacrificing the ability of the equipment to load bags in a horizontal mode. The bag transporting apparatus is capable of pulling and, with its pressers, securing from 67% to 100% of the bag length onto the loading horn. This facilitates loading by shielding the bag mouth and a majority of the bag from the product which, otherwise, would strip the bag from the horn without seating in the bottom of the bag.

Loading force and severity of stuffing is reduced by the horn by utilizing a polygonal shape which more closely matches the product shape; utilizing a gradual taper in the horn geometry; and incorporating flexible members.

Other components typical of a bag loading system can be used with benefit in connection with the present invention. These are well known and conventional and need no further description for those skilled in the art.

A bag [8] as shown in the drawings is preferably one of a plurality of like bags stacked in imbricated (shingled) fashion in a bag loading system. An imbricated taped bag arrangement is well known in the art. When used in a vertical opening system as described herein, the adhesive tapes can themselves function as the means for supporting the bag, or a separate plate, baffle, or the like can be used, in any suitable orientation. Bags can be advanced by any suitable means, such as by a conventional taped bag indexer (not shown), or any suitable device or process. The bags can be shingled "forward", i.e. the topmost bag in the stack of bags is furthest advanced or forward, and closest to the means for opening. Any subsequent packaging steps, such as vacuumizing, heat sealing, shrinking, etc. can be performed as desired.

Any films, especially thermoplastic films such as olefinic films with or without oxygen barrier functionality, can be used with benefit in this invention. These films are made by extrusion coating, coextrusion, lamination, or other suitable processes. Especially preferred for many applications are films comprising an outer layer, an intermediate layer, and an inner layer. The materials of the outer layer are often chosen for abuse resistance and/or sealability, and can be chosen from any suitable polymeric materials such as polyolefins, especially ethylenic polymers and copolymers, polypropylene, polyesters, polyamides, and the like. The inner layer materials, often chosen for sealability, can be any of the materials described for the outer layer. The intermediate layer materials are often chosen for their barrier qualities (i.e. barriers to oxygen, moisture, carbon dioxide, etc.). Preferred materials include polyvinylidene chloride polymers and copolymers, ethylene vinyl alcohol copolymer, polyvinyl alcohol, polyamide, polyester, acrylonitrile, and the like. Bags are preferably heat shrinkable, and preferably at least partially crosslinked.

It is to be understood that variations of the present invention can be made without departing from the scope of the invention, which is not limited to the specific embodiments and examples disclosed herein, but extends to the claims presented below.

Although the invention as described herein is preferably used in connection with taped bags (a very common commercial bag system), it can be beneficially used even without the use of adhesive tapes. With respect to the opening method described herein, the opening of a bag without an adhesive tape can still benefit from the use of the first and second means for vacuumizing to open a bag, in any of the embodiments described herein. The same is true for the transporting and loading apparatus and methods disclosed herein, although of course these are already described herein with respect to a bag which has already been detached from the tapes.

The methods and apparatus described and claimed herein can be used in connection with bags with panels of uneven length, and in connection with bags with curved bag lips.

Although the preferred use of the invention is in connection with the opening of bags held in a substantially vertical position (i.e. horizontal bag mouth), followed by transporting to a substantially horizontal position for the bags (i.e. vertical bag mouth), other orientations of the bag and bag mouth, between horizontal and vertical, are also possible.

What is claimed is:

1. A method of opening a bag mounted on a tape comprising:

a) providing a bag comprising a first panel, a second panel, a first bag edge, a second bag edge, a bag bottom, and a bag mouth;

b) providing a first means for vacuumizing for the first panel and a second means for vacuumizing for the second panel;

c) drawing a vacuum through said first means for vacuumizing and second means for vacuumizing;

d) gripping the bag between the first means for vacuumizing and the second means for vacuumizing; and e) moving the first and second means for vacuumizing such that the bag disengages from the tape, and the bag mouth opens.

2. The method of claim 1 wherein, in step e), the first and second means for vacuumizing are moved in the same direction, at the same velocity, causing the bag to detach from the tape, and then the first means for vacuumizing is moved further, causing the bag mouth to open.

3. The method of claim 1 wherein, in step e), the first and second means for vacuumizing are moved in the same direction, the first means for vacuumizing moving at a greater velocity than the second means for vacuumizing, thus causing the bag to detach from the tape, and causing the bag mouth to open.

4. The method of claim 1 further comprising, prior to step c), advancing the bag to a means for supporting the bag.

5. The method of claim 1 wherein the first means for vacuumizing and the second means for vacuumizing are respectively disposed laterally on either side of the bag, the bag mouth being disposed in a horizontal position.

6. A method of opening a bag mounted on a tape comprising:

a) providing a bag comprising a first panel, a second panel, a first bag edge, a second bag edge, a bag bottom, and a bag mouth;

b) gripping the first and second panels of the bag between a first means for vacuumizing and a second means for vacuumizing;

c) drawing a vacuum through the first means for vacuumizing and the second means for vacuumizing; and d) moving the first and second means for vacuumizing such that the bag disengages from the tape, and the bag mouth opens.

7. The method of claim 6 wherein, in step d), the first and second means for vacuumizing are moved in the same direction, at the same velocity, causing the bag to detach from the tape, and then the first means for vacuumizing is moved further, causing the bag mouth to open.

8. The method of claim 6 wherein, in step d), the first and second means for vacuumizing are moved in the same direction, the first means for vacuumizing moving at a greater velocity than the second means for vacuumizing, thus causing the bag to detach from the tape, and causing the bag mouth to open.

9. The method of claim 6 further comprising, prior to step b), advancing the bag to a means for supporting the bag.

10. The method of claim 6 wherein the first means for vacuumizing and the second means for vacuumizing are respectively disposed laterally on either side of the bag, the bag mouth being disposed in a horizontal position.

11. A method of opening a bag mounted on a tape comprising:

a) providing a bag comprising a first panel, a second panel, a first bag edge, a second bag edge, a bag bottom, and a bag mouth;

b) gripping the first and second panels of the bag between a first means for vacuumizing and a second means for vacuumizing; and c) moving the first and second means for vacuumizing, and, while moving the first and second means for vacuumizing, drawing a vacuum through the first and second means for vacuumizing such that the bag disengages from the tape, and the bag mouth opens.

12. The method of claim 11 wherein, in step c), the first and second means for vacuumizing are moved in the same direction, at the same velocity, causing the bag to detach from the tape, and then the first means for vacuumizing is moved further, causing the bag mouth to open.

13. The method of claim 11 wherein, in step c), after vacuumization of the first and second means for vacuumizing, the first and second means for vacuumizing are moved in the same direction, the first means for vacuumizing moving at a greater velocity than the second means for vacuumizing, thus causing the bag to detach from the tape, and causing the bag mouth to open.

14. The method of claim 11 further comprising, prior to step b), advancing the bag to a means for supporting the bag.

15. The method of claim 11 wherein the first means for vacuumizing and the second means for vacuumizing are respectively disposed laterally on either side of the bag, the bag mouth being disposed in a horizontal position.

* * * * *